US005373712A

United States Patent [19]

Yamamoto et al.

[11] Patent Number: 5,373,712

[45] Date of Patent: Dec. 20, 1994

[54] WARP-KNIT CLOTH FOR SURFACE FASTENER

[75] Inventors: Toru Yamamoto, Osaka; Yoshio Matsuda; Mitsutoshi Ishihara, both of Toyama, all of Japan

[73] Assignee: Yoshida Kogyo K.K., Tokyo, Japan

[21] Appl. No.: 124,215

[22] Filed: Sep. 21, 1993

[30] Foreign Application Priority Data

Sep. 21, 1992 [JP] Japan ..... 4-080875[U]

[51] Int. Cl.[5] ..... D04B 21/02; A44B 18/00

[52] U.S. Cl. ..... 66/195; 66/192; 24/450

[58] Field of Search ..... 66/191, 192, 194, 195; 24/450, 451, 445

[56] References Cited

U.S. PATENT DOCUMENTS

| | | | |
|---|---|---|---|
| 2,691,286 | 10/1954 | Cooper | 66/192 |
| 3,845,641 | 11/1974 | Waller | 66/192 |
| 4,280,259 | 7/1981 | Bassist | 28/160 |
| 4,858,447 | 8/1989 | Matsuda | 66/192 X |
| 5,074,129 | 12/1991 | Matthew | 66/192 |

FOREIGN PATENT DOCUMENTS

| | | | |
|---|---|---|---|
| 0284020 | 9/1988 | European Pat. Off. . | |
| 1015005 | 4/1952 | France | 66/192 |
| 1035395 | 4/1953 | France | 66/192 |
| 1150580 | 1/1958 | France | 66/192 |
| 975881 | 10/1962 | Germany | 66/192 |
| 2507876 | 9/1976 | Germany . | |
| 63-91009 | 6/1988 | Japan . | |
| 1043203 | 9/1983 | U.S.S.R. | 66/192 |
| 1046360 | 10/1983 | U.S.S.R. | 66/192 |
| 1666596 | 7/1991 | U.S.S.R. | 66/194 |

*Primary Examiner*—Clifford D. Crowder
*Assistant Examiner*—John J. Calvert
*Attorney, Agent, or Firm*—Hill, Steadman & Simpson

[57] ABSTRACT

A warp-knit cloth for a surface fastener, comprising: a foundation design knitted of pile knitting yarns and foundation yarns so as to form pile loops, which serve as engaging elements of the surface fastener, on wales; a marquisette design in which inlaid yarn extend in the wale direction and course direction so as to form squared meshes, which serve as vents, between said wales.

4 Claims, 8 Drawing Sheets

WARP-KNIT CLOTH FOR SURFACE FASTENER

BACKGROUND OF THE INVENTION

1. Field of the Invention

This invention relates to a warp-knit cloth to be used in a surface fastener, and more particularly to a warp-knit cloth for a surface fastener to be used in clothing, shoes and bags, which have air-permeability, and cleaning tools, such as mats and mops, which have air-permeability and water-permeability.

2. Description of the Related Art

A conventional surface fastener cloth having air-permeability is known from, for example, Japanese Utility Model Laid-Open Publication No. SHO 63-91009, in which a knit/woven cloth having pile loops on one surface is provided with circular through-holes in a checker-board pattern or a zigzag pattern and is treated at the back surface with coating treatment so that a female member of the surface fastener is formed.

However, with the conventional surface fastener, since in an attempt to keep adequate engaging force, the female member has through-holes spaced apart from one another by a distance larger than the hole diameter to have an increased area for engaging pile loops, high air-permeability cannot be achieved, and especially when used in a cleaning tool, dirt and dust tend to stick to the female member, thus deteriorating the water-permeability.

SUMMARY OF THE INVENTION

It is therefore an object of this invention to provide a warp-knit cloth, for surface fasteners, which has high air-permeability and adequate engaging force.

According to this invention, there is provided a warp-knit cloth for a surface fastener, comprising: a foundation design knitted of pile knitting yarns and foundation yarns so as to form pile loops, which serve as engaging elements of the surface fastener, on wales; a marquisette design in which inlaid yarn extend in the wale direction and course direction so as to form squared meshes, which serve as vents, between said wales.

DETAILED DESCRIPTION

Embodiments of this invention will now be described with reference to the accompanying drawings.

Figure 1:
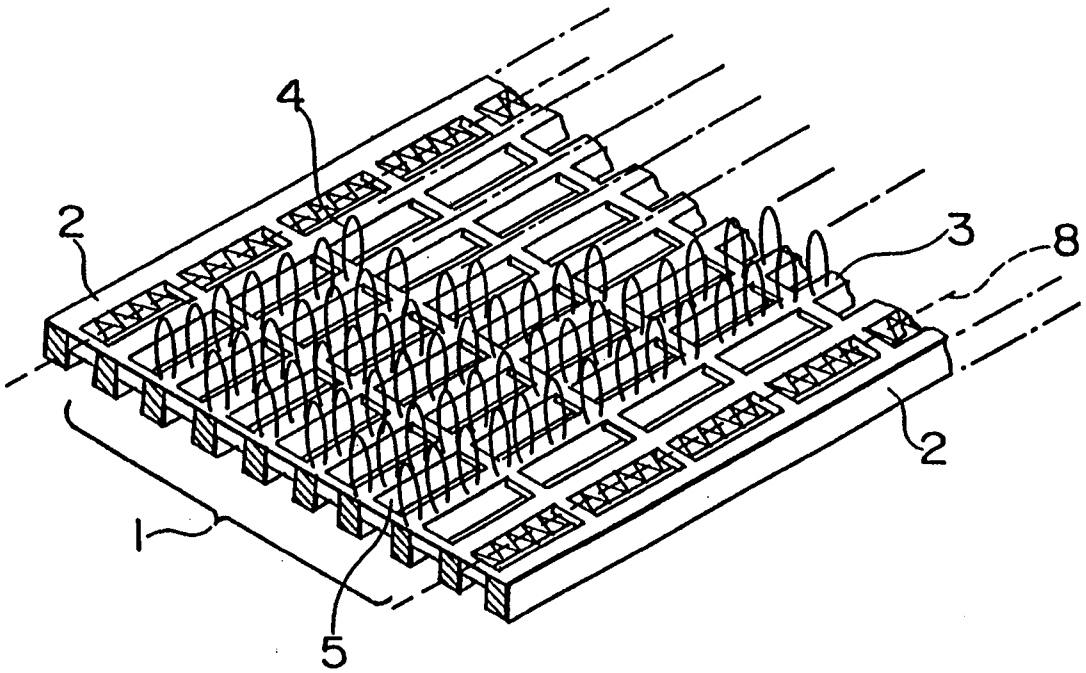
FIG. 1 is a perspective view diagrammatically showing a warp-knit surface fastener cloth according to a first embodiment of this invention.
Figure 2:
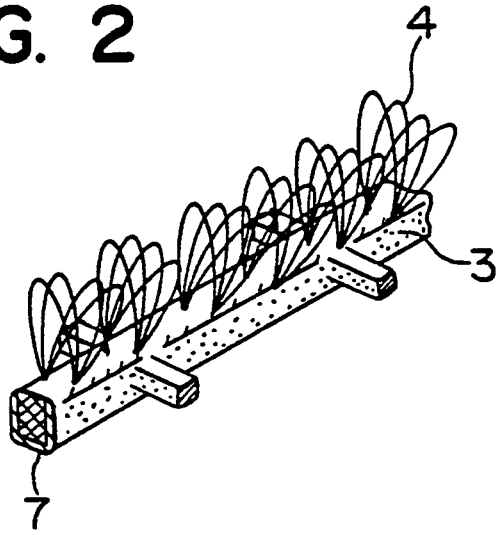
FIG. 2 is a perspective view diagrammatically showing one wale of the cloth of the first embodiment.

FIG. 1 diagrammatically shows a warp-knit surface fastener cloth embodying this invention, and FIG. 2 diagramtically shows one wale.

Figure 3:
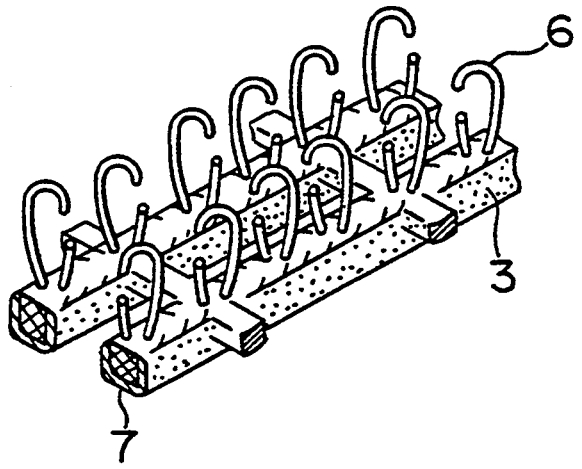
FIG. 3 is a perspective view diagrammatically showing the wales of the male-type cloth of the first embodiment.

The warp-knit surface fastener cloth (hereinafter called "the cloth") comprises, as shown in FIG. 1, a pile portion 1 situated at the center and a pair of edge portions 2, .2 situated at opposite sides of the pile portion 1. The pile portion 1, as shown in FIG. 2, has a multiplicity of pile loops 4, which serves as engaging portions extending along the respective wales 3, and a multiplicity of squared meshes 5 between the wales 3, 3, which give the pile portion 1 air-permeability and water-permeability. Knitting yarns for forming the pile loops 4 may be monofilament yarns as shown in FIG. 1 or multifilament yarns as shown in FIG. 2 when knitting the female-type surface fastener cloth. On the other hand, when knitting the male-type surface fastener cloth, pile loops are knitted using monofilament yarns as shown in FIG. 3, whereupon the pile loops 4 are cut on side near top to form hooks 6. The back side of the cloth, as shown in FIGS. 2 and 3, is provided with coating treatment such as with synthetic rubber or resin in order to prevent the pile loops 4 and the hooks 6 from being removed and to give the knitted structure a shape-keeping characteristic. In a coating layer 7, foundation yarns L2 and inlaid yarns L3, L4 of a marquisette design are tightly interlaced with the base of the individual pile loop 4 to reduce the coating layer 7 in thickness.

Figure 4:
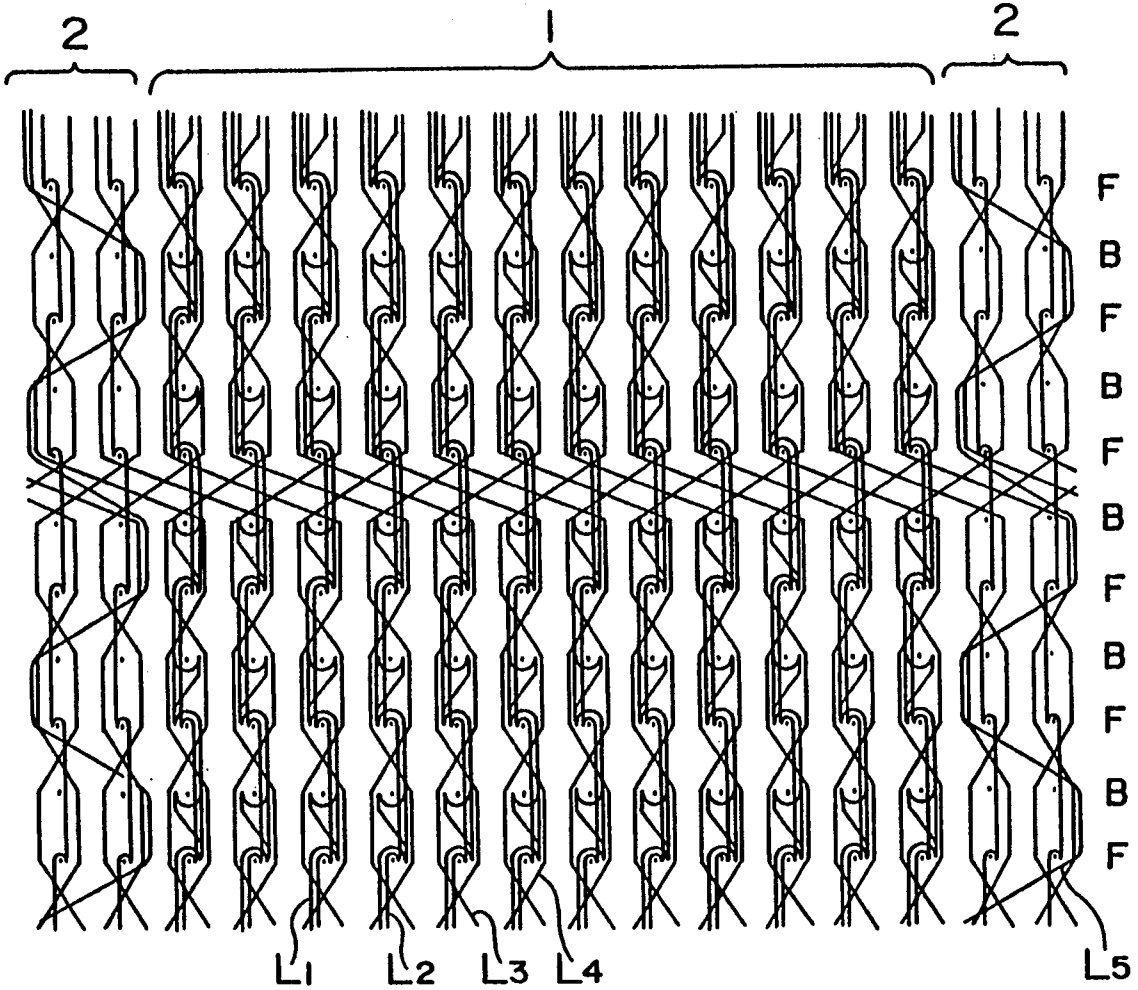
FIG. 4 is a design diagram showing the knit structure of the cloth of the first embodiment.
Figure 5:
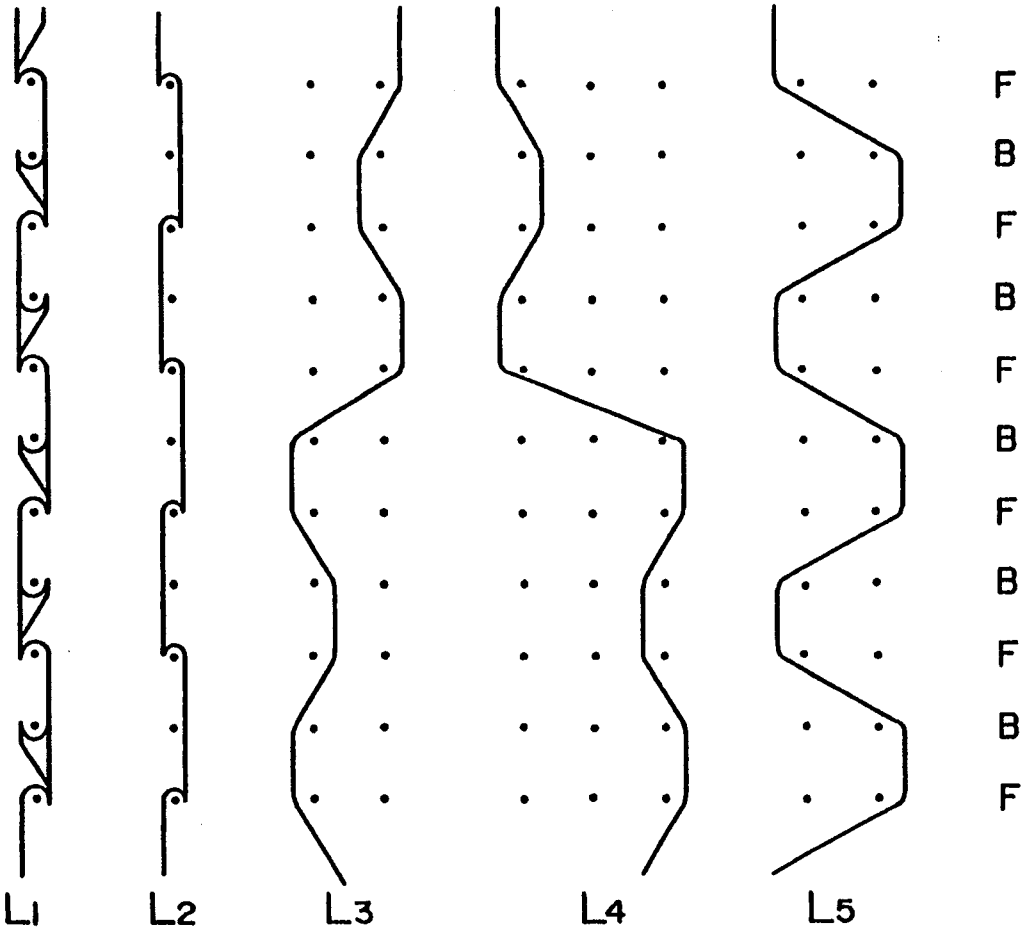
FIG. 5 is a design diagram showing the running of various yarns of the cloth of the first embodiment.
Figure 6:
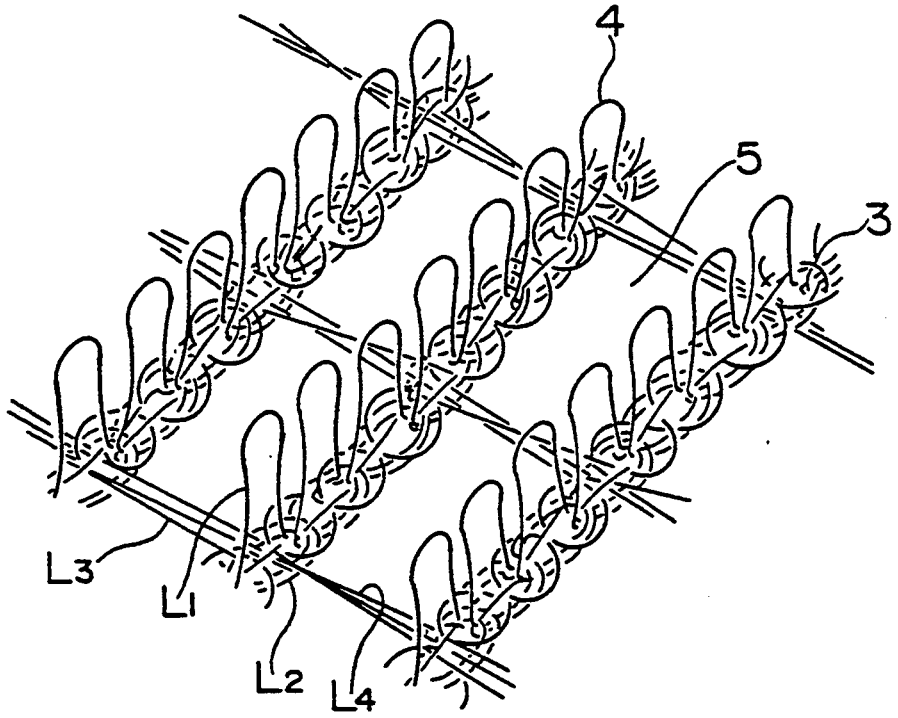
FIG. 6 is an enlarged view showing a portion of the cloth of the first embodiment.

FIG. 4 is a design diagram showing the cloth of this invention, and FIG. 5 is a design diagram showing various kinds of yarns. The cloth is knitted on a double Russell knitting machine equipped with two rows of needle threads. In FIGS. 4 and 5, B represents a back needle, and F represents a front needle. The central pile portion 1 is knitted of pile knitting yarns L1, foundation yarns L2 and two kinds of inlaid yarns L3, L4. The pile knitting yarns L1 are yarns forming the pile loops 4 and each runs in a pattern of 1-0/1-1/0-1/0-0/1-0, forming wales 3 together with the foundation yarns L2 by the front needle and causing the pile loops 4 to stand up on and along the wales 3 by the back needle. The foundation yarns L2 are knitted with the wales 3, which constitute a foundation design of the cloth, and each is a chain stitch of 1-0/0-0/0-1/1-1. The yarns L3 and L4 are inlaid yarns constituting a marquisette design in which L3 runs in a pattern of 2-2/2-2/1-1/1-1/2-2/2-2/0-0/0-0/1-1/1-1/0-0/0-0, while L4 runs in a pattern of 0-0/0-0/1-1/1-1/0-0/0-0/3-3/3-3/2-2/2-2/3-3/3-3. The inlaid yarns L3, L4 are interlaced with the knitting yarns L1 together with the foundation yarns L2 in and along the wales by the front needle and the inlaid yarns L3, L4 are laid in the courses in opposite directions and extend over a range of one to three wales for every course, thus forming squared meshes 5. Therefore, though ill the presence of the meshes 5, the knitted cloth is stable both in warp and weft directions; the inlaid yarns L3 and L4 together with the foundation yarns L2 are tightly interlaced with the base of the individual pile loop 4 to keep the pile loop 4 standing in a safe state as shown in FIG. 6, thus increasing the engaging force. Although it depends on the use, the size of the meshes 5 should preferably be in a range of 1 to 5 mm. It is also preferable that two or three pile loops 4 should be formed over a single-mesh length of the individual wale 3 in view of the engaging force with the male-type surface fastener.

The edge portion 2 is knitted of the foundation yarns L2 and reinforcing inlaid yarns L5 and is a margin to sew up by sewing thread 8 for attaching the surface fastener to a garment. In production, a wide cloth is knitted and is then cut into individual narrow surface fasteners along several edge portions 2, which are knitted at every predetermined width. Partly since the back surface of the cloth is provided with a coating layer 7 as shown in FIGS. 2 and 3 and partly since the foundation yarns L2 and the auxiliary inlaid yarns L5 are knitted double, the cut edges are free from being frayed.

In the foregoing embodiment of FIGS. 4 through 6, the cloth is knitted on a double Russell knitting machine. Alternatively, the cloth may be knitted even on a single Russell knitting machine with the same result that the cloth has squared meshes.

Figure 7:
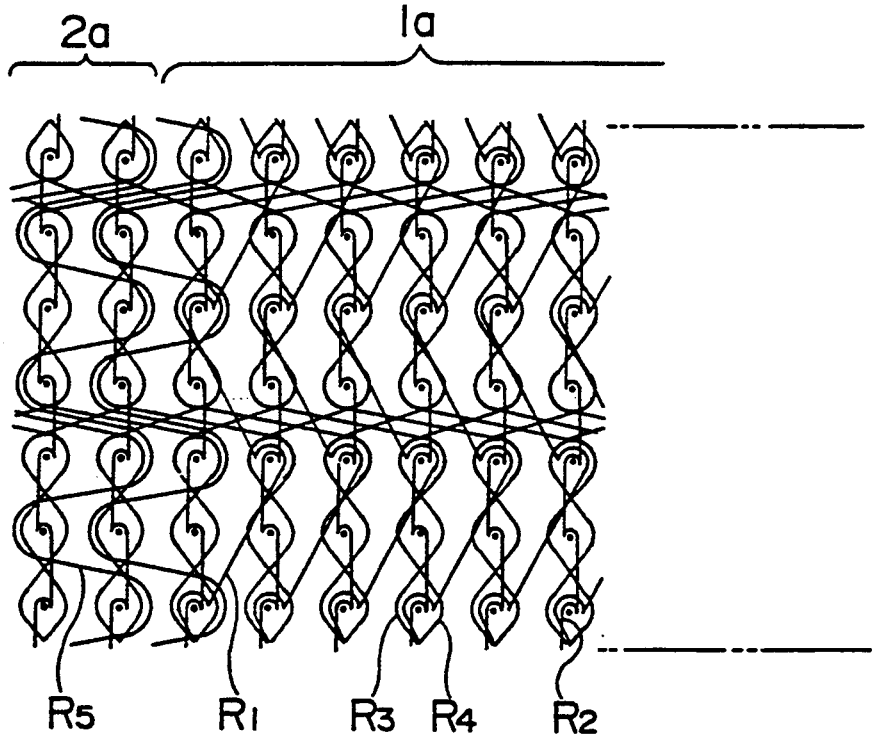
FIG. 7 is a design diagram showing the knit structure of a cloth according to a second embodiment.
Figure 8:
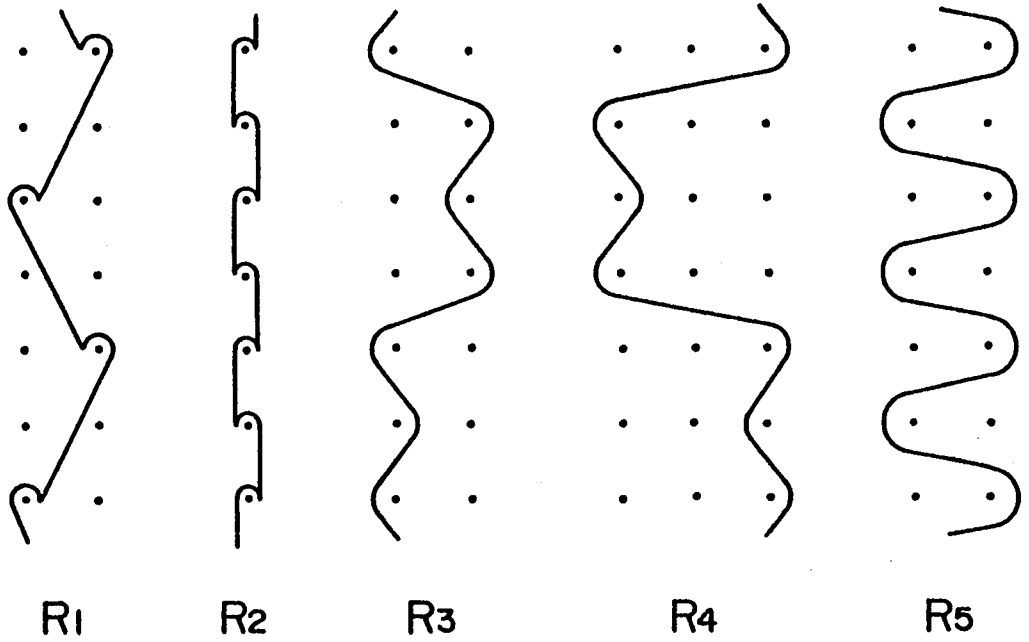
FIG. 8 is a design diagram showing the running of various yarns of the cloth of the second embodiment.
Figure 9:
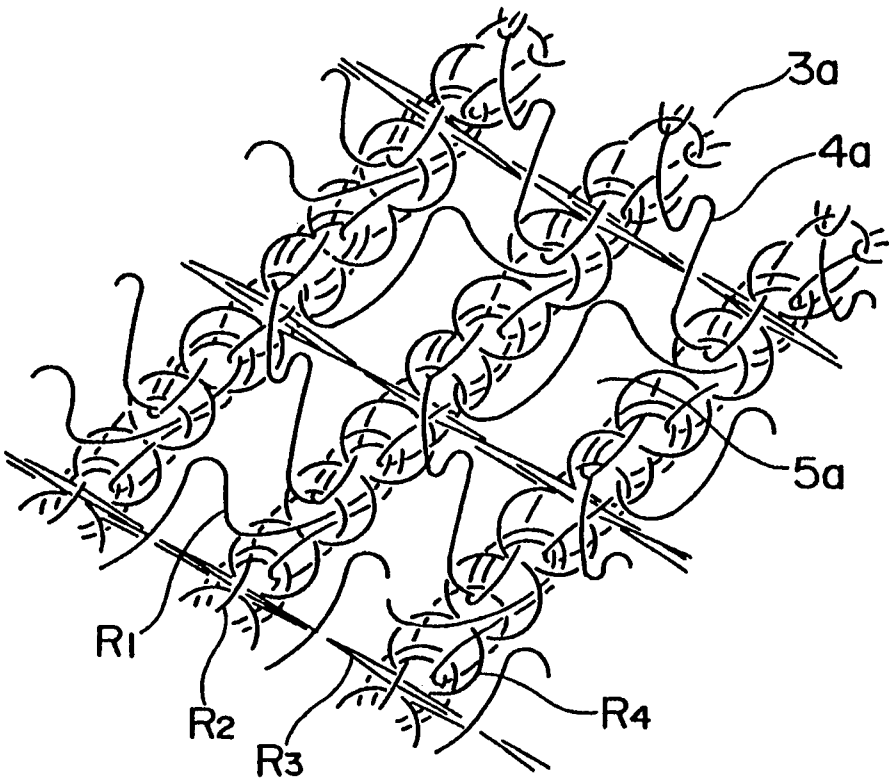
FIG. 9 is an enlarged view showing a portion of the cloth of the second embodiment.

FIGS. 7 through 9 shows a second embodiment. In the first embodiment of FIGS. 4 through 6, the pile loops constituting engaging elements of the surface fastener are formed on and along the wales of the foundation system knitted of the foundation yarns L2. Whereas in the second embodiment of FIGS. 7 through 9, though pile loops 4*a* are formed between adjacent wales 3*a*, 3*a*, squared meshes 5*a* are formed by inlaid yarns R3 and R4 of the marquisette design like the first embodiment.

FIG. 7 is a design diagram of the second embodiment, and FIG. 8 is a design diagram showing the running of the yarns of the second embodiment. In the second embodiment, the cloth is knitted on a single Russell knitting machine.

In the pile portion 1*a*, the wales 3*a* of the foundation design is knitted of pile knitting yarns R1 and foundation yarns R2, and pile knitting yarns R1 forms pile loops 4*a* on adjacent needles as shown in FIG. 8, each pile loop 4*a* extending between adjacent wales 3*a*, 3*a* as shown in FIG. 9, thus facilitating the engagement of this cloth with a male-type surface fastener. The remaining yarns, i.e. the foundation yarns R2, the inlaid yarns R3, R4 of the marquisette design, and reinforcing inlaid yarns R5 of the edge portions 2*a*, are basically identical with those of the first embodiment.

With the cloth thus constructed, partly since pile loops are formed on the wales of the foundation design and partly since squared meshes are formed between adjacent wales, it is possible to give air-permeability to the surface fastener without lowering the engaging force. Further, since the meshes fully occupy the entire space between the wales, it is possible to give high air-permeability to the cloth so that the cloth can be used in a cleaning tool, to which dust and dirt are apt to stick. In addition, since the base of the individual pile loop is tightly interlaced with the inlaid yarns of the marquisette design, the pile loops are kept standing in a stable state and are also prevented from being removed, thus reducing the thickness of the coating layer over the back surface of the cloth.

What is claimed is:

1. A warp-knit cloth for a surface fastener, comprising:

(a) a foundation design knitted of pile knitting yarns and foundation yarns so as to form pile loops, which serve as engaging elements of the surface fastener, on wales; and (b) a marquisette design in which inlaid yarns extend in a direction along said wales and a direction perpendicular to said wales forming course so as to form squared meshes, which serve as vents, between said wales, each said wale providing a plurality of loops between courses.

2. A warp-knit surface fastener cloth according to claim 1, wherein said pile knitting yarns run in a pattern of 1-0/1-1/0-1/0-0/1-0.

3. A warp-knit surface fastener cloth according to claim 1, wherein said foundation yarns run 1-0/0-0/0-1/1-1.

4. A warp-knit surface fastener cloth according to claim 1 wherein one set of said inlaid yarns run in a pattern of 2-2/2-2/1-1/1-1/2-2/2-2/0-0/0-0/1-1/1-1/0-0/0-0, while the other set of said inlaid yarns run in a pattern of 0-0/0-0/1-1/1-1/0-0/0-0/3-3/3-3/2-2/2-2/3-3/3-3.

* * * * *